US007270749B1

(12) United States Patent
Wall

(10) Patent No.: US 7,270,749 B1
(45) Date of Patent: Sep. 18, 2007

(54) PUMP SYSTEM

(75) Inventor: Ronald L. Wall, Dallas, TX (US)

(73) Assignee: Intellicool LLC, Richardson, TX (US)

( * ) Notice: Subject to any disclaimer, the term of this patent is extended or adjusted under 35 U.S.C. 154(b) by 101 days.

(21) Appl. No.: 10/910,334

(22) Filed: Aug. 3, 2004

(51) Int. Cl.
*B05B 17/00* (2006.01)
*B01D 29/50* (2006.01)

(52) U.S. Cl. ..... 210/201; 210/206; 210/416.1; 239/551

(58) Field of Classification Search ..... 210/198.1, 210/201, 205, 206, 416.1, 424; 239/551, 239/575
See application file for complete search history.

(56) References Cited

U.S. PATENT DOCUMENTS 2,022,970 A * 12/1935 Meynen ..... 99/323.12
2,227,544 A 1/1941 Gymnaites
2,775,952 A * 1/1957 Schur ..... 118/674
3,092,328 A * 6/1963 Patterson et al. ..... 239/150
3,196,892 A * 7/1965 Savage et al. ..... 137/114
3,293,861 A * 12/1966 Nelson ..... 405/61
3,337,133 A * 8/1967 Duerkob ..... 239/18
3,375,980 A * 4/1968 Hinrichs ..... 239/411
3,394,811 A * 7/1968 Wasp et al. ..... 210/768
3,469,706 A * 9/1969 Kissell ..... 210/448
3,655,054 A * 4/1972 Pansini ..... 210/169
3,812,969 A * 5/1974 Maroney ..... 210/274
3,843,056 A * 10/1974 Nye ..... 239/64
3,889,881 A * 6/1975 Cunningham et al. ..... 239/70
4,476,809 A 10/1984 Bunger
4,551,987 A 11/1985 Cutlip
4,721,250 A 1/1988 Kennedy et al.
5,074,124 A 12/1991 Chapman
5,117,644 A 6/1992 Fought
5,143,293 A 9/1992 Pairis
5,173,122 A * 12/1992 Tilby et al. ..... 127/2
5,246,168 A 9/1993 Williams
5,303,729 A 4/1994 DeMarco
5,342,510 A * 8/1994 Eden et al. ..... 210/96.1
5,353,990 A 10/1994 Williams
5,364,030 A 11/1994 Murdock et al.
5,366,159 A 11/1994 Childers
5,401,420 A * 3/1995 Siefert et al. ..... 210/709
5,413,280 A 5/1995 Taylor (Continued)

OTHER PUBLICATIONS

Southern Accents, Dallas Show House, Sep./Oct. edition 2003, p. 113, Dallas, Texas.

*Primary Examiner*—Fred G. Prince
(74) *Attorney, Agent, or Firm*—Standley Law Group LLP

(57) ABSTRACT

A pumping system comprising: (a) an inlet adapted for connection with a supply of low pressure water; (b) a filtration unit in fluid communication with the inlet, wherein the filtration unit filters impurities from the low pressure water so as to discharge a flow of filtered water; (c) a pump in fluid communication with the filtration unit, the pump adapted to discharge a flow of pressurized water; (d) a valve manifold in fluid communication with the pump, the valve manifold comprising at least two discharge ports, the valve manifold operable to individually actuate each discharge port so as to regulate fluid flow therethrough, each discharge port being capable of discharging a stream of high pressure water; and (e) at least a respective number of outlets as discharge ports, each outlet in fluid communication with a respective discharge port so as to receive the stream of high pressure water.

20 Claims, 5 Drawing Sheets

U.S. PATENT DOCUMENTS 5,507,945 A 4/1996 Hansen
5,667,683 A * 9/1997 Benian ..... 210/409
5,699,827 A 12/1997 Delorme et al.
5,775,593 A 7/1998 Delorme et al.
5,823,430 A 10/1998 Clark, Jr. et al.
5,833,144 A * 11/1998 Kinter ..... 239/462
5,905,570 A * 5/1999 White et al. ..... 356/317
5,958,243 A * 9/1999 Lawrence et al. ..... 210/636
6,036,107 A * 3/2000 Aspen et al. ..... 239/170
6,056,873 A * 5/2000 Hartley et al. ..... 210/90
6,253,565 B1 7/2001 Arledge
6,293,121 B1 9/2001 Labrador
6,423,218 B1 * 7/2002 Lindermeir et al. ..... 210/170
6,471,194 B2 10/2002 Keeney
6,517,617 B1 * 2/2003 Chartier et al. ..... 106/14.42
6,581,855 B1 * 6/2003 Cook ..... 239/550
6,638,422 B1 * 10/2003 Schwartzkopf ..... 210/108
6,669,556 B2 12/2003 Gautney
2002/0011436 A1 * 1/2002 Blanchette et al. ..... 210/198.1
2006/0096549 A1 * 5/2006 Rapp ..... 119/665
2006/0162354 A1 * 7/2006 Jensen ..... 62/171

* cited by examiner

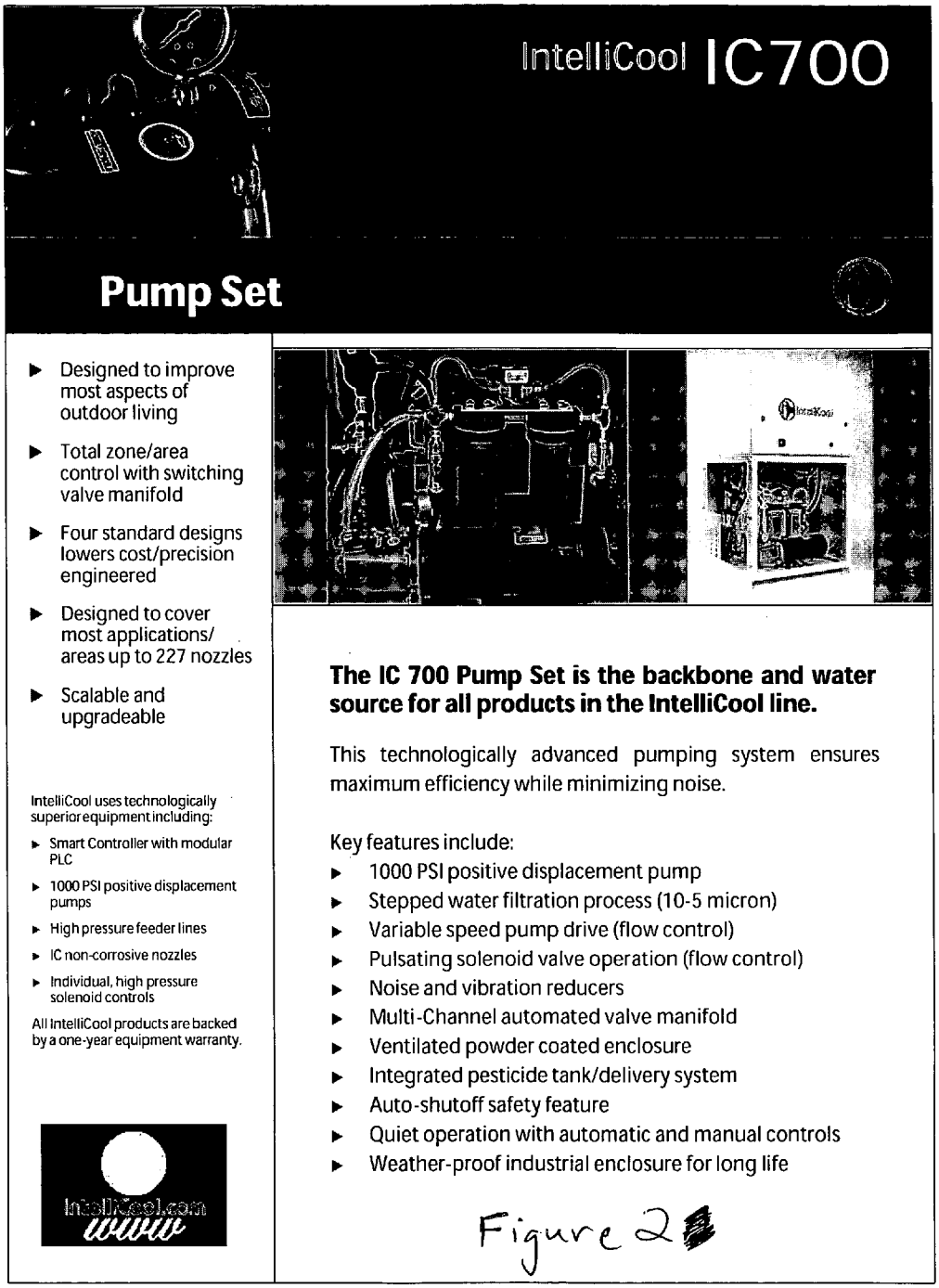

IntelliCool IC700

Pump Set

- Designed to improve most aspects of outdoor living
- Total zone/area control with switching valve manifold
- Four standard designs lowers cost/precision engineered
- Designed to cover most applications/ areas up to 227 nozzles
- Scalable and upgradeable IntelliCool uses technologically superior equipment including:

- Smart Controller with modular PLC
- 1000 PSI positive displacement pumps
- High pressure feeder lines
- IC non-corrosive nozzles
- Individual, high pressure solenoid controls All IntelliCool products are backed by a one-year equipment warranty.

IntelliCool.com www

The IC 700 Pump Set is the backbone and water source for all products in the IntelliCool line.

This technologically advanced pumping system ensures maximum efficiency while minimizing noise.

Key features include:

- 1000 PSI positive displacement pump
- Stepped water filtration process (10-5 micron)
- Variable speed pump drive (flow control)
- Pulsating solenoid valve operation (flow control)
- Noise and vibration reducers
- Multi-Channel automated valve manifold
- Ventilated powder coated enclosure
- Integrated pesticide tank/delivery system
- Auto-shutoff safety feature
- Quiet operation with automatic and manual controls
- Weather-proof industrial enclosure for long life

Figure 2

IntelliCool IC700

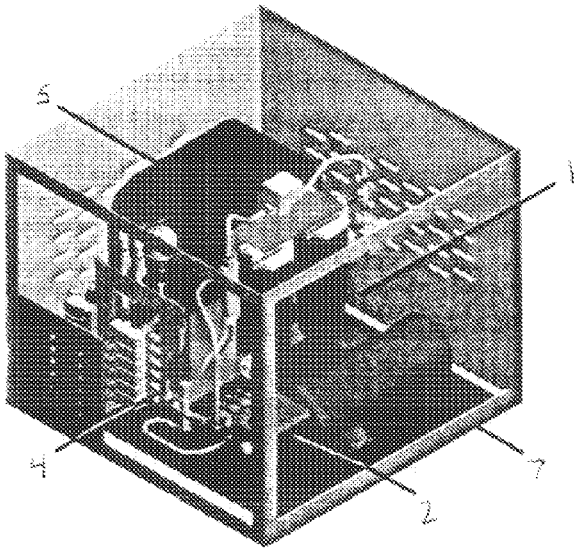

The IC 700 Pump Set includes:

1. CAT® positive displacement pump
2. Staged cartridge filters
3. Automated pulsating/ switching valve manifold
4. Insecticide tank
5. Weatherproof enclosure

FIG. 3

IC 700 Pump Set

| Pump Size | Flow Rate (GPM) | Max. Number of Nozzles | Number of Zones | Hp |
|---|---|---|---|---|
| Size 1 | .5 | 23 | 1 | 1/3 |
| Size 2 | 2.7 | 122 | 1-12 | 2 |
| Size 3 | 3.5 | 160 | 1-12 | 3 |
| Size 4 | 5.0 | 227 | 1-12 | 5 |

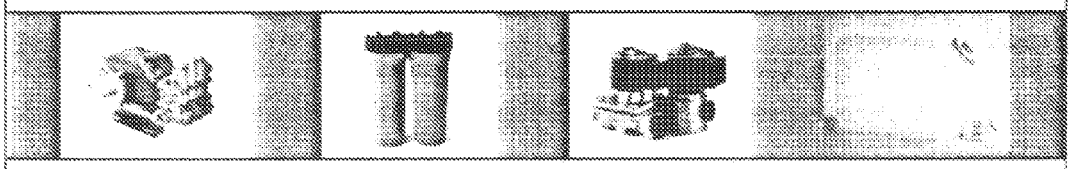

CAT® Positive Displacement Pump FIG. 4

Staged Cartridge Filters FIG. 5

Automatic Pulsating/ Switching Valve Manifold FIG 6

Insecticide Tank FIG. 7

IntelliCool

17630 Davenport Road #101
Dallas, TX 75252
Phone 972-267-3322
Fax 972-267-3326
www.intellicool.com

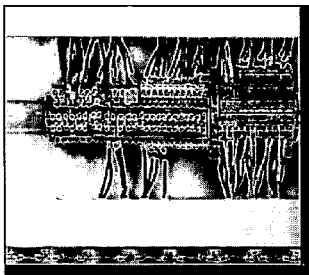

IntelliCool IC710

Pump Set Control Panel

- 24 V DC power source
- Programmable logic controller
- Circuit breaker protection
- NEMA 4 enclosure
- UL Approved
- Variable speed control of pump
- Variable speed control of fans
- Solenoid pulsation control
- Individual zone control IntelliCool uses technologically superior equipment including:

- Smart Controller with modular PLC
- 1000 PSI positive displacement pumps
- High pressure feeder lines
- IC non-corrosive nozzles
- Individual, high pressure solenoid controls All IntelliCool products are backed by a one-year equipment warranty.

IntelliCool.com www

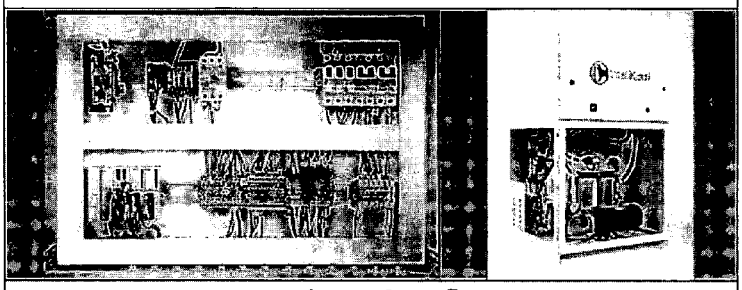

Fig. 8

The IC 710 Pump Set Control Panel is a NEMA 4 enclosure, meaning the enclosure is water tight and dust tight.

The Control Panel, mounted to the top of the Pump Set, houses all the electronic control hardware and the electrical circuit protection equipment. Also mounted in the Control Panel is the programmable logic controller which controls the full operation of the pump set and acts as the interface between the pump hardware and the user. It is through the programmable logic controller that each zone of the evaporative cooling system is individually operated in either an automatic or manual mode of operation.

IntelliCool IC710

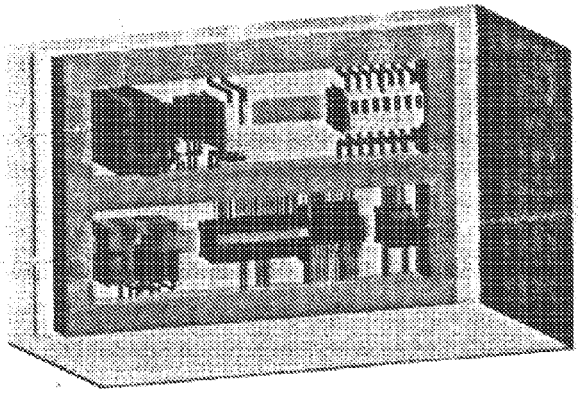

IC 710 Pump Set Control Panel FIG. 9

IC 710 Pump Set Control Panel Features:

1. Electrical Circuit Protection (Safety Feature)
2. 24 volt DC power supply to power all devices outside the pump set enclosure (Safety Feature)
3. Contactor to remove power from the motor controller when the pump motor is not running (Safety Feature and Energy Savings)
4. Variable speed pump motor controller to control the amount of water the pump discharges (Energy Savings)
5. Programmable Logic Controller to monitor and control the operation of the hardware (System Intelligence)
6. Individual isolated relays for A/C Condenser Cooling (Safety Feature)
7. Terminations for all wires entering or leaving the Control Panel (Ease of Maintenance)
8. NEMA 4 Enclosure to protect the enclosed electrical equipment from dust and rain IntelliCool 17630 Davenport Road #101
Dallas, TX 75252
Phone 972-267-3322
Fax 972-267-3326
www.intellicool.com

PUMP SYSTEM

TECHNICAL FIELD OF THE INVENTION

The present invention is in the field of pumping systems. Specifically, the present invention is in the field of above-ground enclosed pumping systems for delivering a high pressure supply of water to a misting system.

BACKGROUND OF THE INVENTION

As used herein the term "dry-bulb temperature" ($T_{db}$) is usually referred to as air temperature, the air property that is most familiar. Dry-bulb temperature can be measured using a thermometer. The dry-bulb temperature is an indicator of heat content.

As used herein, the term "wet-bulb temperature" ($T_{wb}$) represents how much moisture the air can evaporate. This temperature can be measured with a thermometer that has the bulb covered with a water-moistened bandage and with air flowing over the thermometer.

As used herein, the term "relative humidity" (RH) is the ratio of the water vapor pressure ($P_v$) to the vapor pressure of saturated air at the same temperature ($P_{vs}$), expressed as a percentage. The moisture-holding capacity of air increases as air is warmed. In practice, relative humidity indicates the moisture level of the air compared to the air's moisture-holding capacity. The moisture holding capacity of air increases dramatically with an increase in temperature.

As used herein, the term "dew point temperature" ($T_{dp}$) is the temperature at which water vapor starts to condense out of air. Above this temperature, the moisture will stay in the air.

As used herein, the term "enthalpy" (H) is the energy content per unit air weight, typically measured in units of British thermal units per pound of dry air (Btu/$lb_{da}$).

Evaporative cooling is a passive conditioning method that has been effectively utilized for thousands of years. However, despite its wide spread use in many areas of the country, its full benefits have yet to be realized. Evaporative cooling is energy efficient, environmentally benign and cost-effective. The evaporative cooling process is the simultaneous removal of sensible heat and addition of moisture to the air. Simply described, it is the movement of air across a moisture source, which produces a decrease in temperature.

In order to escape the pressures of modern life many people are transforming their homes into an oasis of serenity among the chaos of the outside world. Some of these transformations include improving the aesthetic features of their house, the material possessions contained therein, and the aesthetic features of their yards. However, no matter how aesthetically pleasing one makes their house or yard if the environmental factors (temperature and/or humidity) in that area is not within comfortable ranges that area may not be used. In many regions of the world, the climate is too hot and/or too dry to comfortably enjoy the outdoors (including patios, loggias, and porches). Similarly, the climate in many regions affects indoor comfort to the extent that people are unable to truly enjoy their homes. Accordingly, people have recognized the need to adjust local environmental factors to more suitable levels to maximize the enjoyment of their home and/or yard.

Thus, it is a goal of the present invention to provide an effective pumping system to deliver a plurality of regions or zones (such as patios, loggias, and porches) with a supply of high-pressure water that may be atomized to affect local environmental factors (such as temperature and humidity).

In view of the present disclosure or through practice of the present invention, other advantages may become apparent.

SUMMARY OF THE INVENTION

In general terms, the present invention includes a pumping system comprising: (a) an inlet adapted for connection with a supply of low pressure water; (b) a filtration unit in fluid communication with the inlet so as to receive a flow of low pressure water, wherein the filtration unit filters impurities from the low pressure water so as to discharge a flow of filtered water; (c) a pump in fluid communication with the filtration unit so as to receive the flow of filtered water, the pump adapted to discharge a flow of pressurized water; (d) a valve manifold in fluid communication with the pump so as to receive the flow of pressurized water, the valve manifold comprising at least two discharge ports, the valve manifold operable to individually actuate each discharge port so as to regulate fluid flow therethrough, each discharge port being capable of discharging a stream of high pressure water; and (e) at least a respective number of outlets as discharge ports, each outlet in fluid communication with a respective discharge port so as to receive the stream of high pressure water.

In one embodiment of the present invention, the filtration unit comprises at least one cartridge filter. In yet another embodiment of the present invention, the filtration unit removes impurities larger than about 20 microns. In still another embodiment of the present invention, the filtration unit removes impurities larger than about 10 microns.

In one embodiment, the stream of high pressure water is at a pressure in the range of from about 700 psi to about 1,200 psi.

In one embodiment of the present invention, the pumping system additionally comprises at least one chemical storage tank for introducing chemicals into at least one stream of high pressure water.

In one embodiment, the pumping system of the present invention additionally comprises a weatherproof container which houses at least one of the following components: the filtration unit, the pump, and the valve manifold.

In one embodiment of the present invention, the pumping system additionally comprises a control unit in electrical communication with at least one of the following components: the filtration unit, the pump, and the valve manifold.

In yet another embodiment, the control unit is housed in NEMA 4 enclosure.

The present invention additionally includes a pump system comprising: (a) a filtration unit in fluid communication with a source of low pressure water, wherein the filtration unit filters impurities from the low pressure water so as to discharge a flow of filtered water; (b) a pump in fluid communication with the filtration unit so as to receive the flow of filtered water, the pump adapted to discharge a flow of pressurized water; (c) a valve manifold in fluid communication with the pump so as to receive the flow of pressurized water, the valve manifold comprising at least two discharge ports, the valve manifold operable to individually actuate each discharge port so as to regulate fluid flow therethrough, each discharge port capable of discharging a stream of high pressure water.

In one embodiment of the present invention, the filtration unit comprises at least one cartridge filter. In another embodiment, the filtration unit removes impurities larger than about 20 microns. In yet another embodiment, the filtration unit removes impurities larger than about 10 microns.

In one embodiment, the stream of high pressure water is at a pressure in the range of from about 700 psi to about 1,200 psi.

In one embodiment of the pumping system of the present invention, the pumping system additionally comprises at least one chemical storage tank for introducing chemicals into at least one stream of high pressure water.

In yet another embodiment, the pumping system additionally comprises a weatherproof container which houses at least one of the following components: the filtration unit, the pump, and the valve manifold.

In one embodiment, the pumping system of the present invention additionally comprises a control unit in electrical communication with at least one of the following components: the filtration unit, the pump, and the valve manifold.

In another embodiment, the control unit is housed in NEMA 4 enclosure.

BRIEF DESCRIPTION OF THE DRAWINGS

FIG. 2 depicts two views (one close-up and one perspective) of one embodiment of a pump set of the present invention.

FIG. 3 depicts a perspective view of the pump set of FIG. 2.

FIG. 4 depicts a perspective view of a CAT Positive Displacement Pump for use in the pump set of FIG. 3.

FIG. 5 depicts a front elevation view of staged cartridge filters for use in the pump set of FIG. 3.

FIG. 6 depicts a perspective view of an automatic pulsating switching valve manifold for use in the pump set of FIG. 3.

FIG. 7 depicts a perspective view of an insecticide tank for use in the pump set of FIG. 3.

FIG. 8 depicts two views (one front elevation view and one perspective view) of a pump set control panel for use with the pump set of the present invention.

FIG. 9 depicts a more detailed view of the pump set control panel of FIG. 8.

DETAILED DESCRIPTION OF THE PREFERRED EMBODIMENT(S)

Figure 1:
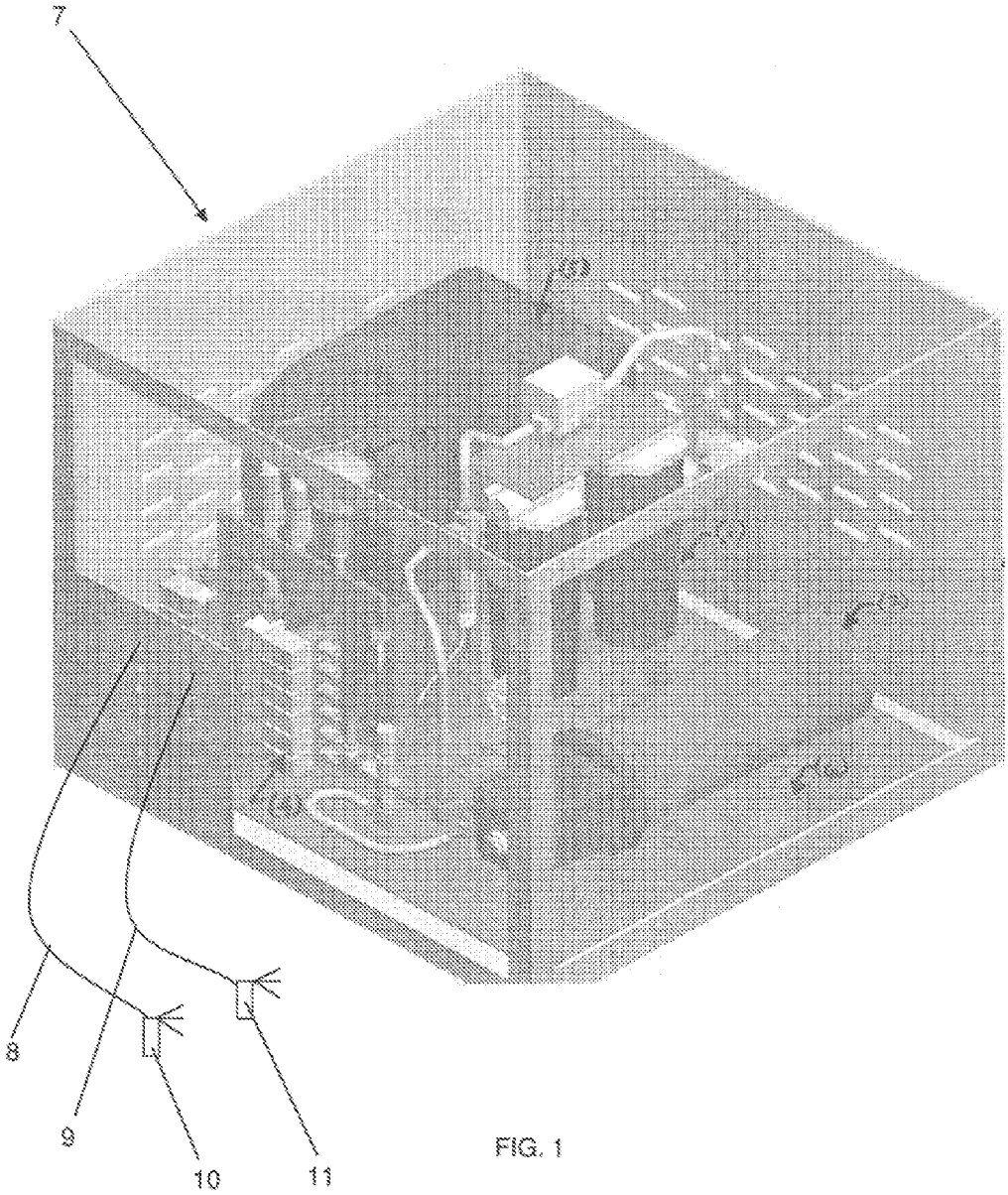
FIG. 1 depicts one embodiment of the pump system of the present invention.

In accordance with the foregoing summary of the invention, the following presents a detailed description of the preferred embodiment of the invention which is presently considered to be its best mode.

With regard to FIG. 1, a supply of low pressure water (typically, a supply of city water) is connected to the pumping system for filtration. Filtration is accomplished by passing the low pressure water through at least one 0.5-micron cartridge filter 1. It is most desirable to pass the low-pressure water through at least two of these cartridges to remove substantially all of the minerals from the low-pressure water that can later deposit throughout the system and cause problems. For instance, the minerals may deposit themselves on the walls of the piping, in the distribution nozzles or on air conditioner evaporators, thereby increasing the overall duty of the system and reducing the effectiveness of the heat transfer operation.

The filtered water is subsequently fed to a positive displacement pump 2 that pressurizes the system to a pressure of at least about 600-psi. It is preferred that the positive displacement pump pressurizes the filtered water to about 1000-psi. Although any positive displacement pump that can pressurize the filtered water to the required pressure may be used, suitable pumps are the Sleeved Direct-Drive Plunger Pumps, such as model 4SF50ELS, manufactured by Cat Pumps of 1681-94$^{th}$ Lane N.E., Minneapolis, Minn. 55449-4324.

A portion of the pressurized water discharged from the positive displacement pump is then fed into an accumulator 3, unless the accumulator is at maximum capacity. An accumulator is a pressure vessel in which the pressurized water is stored. Typically, an accumulator contains a compressible gas, a separator (i.e. piston, bladder diaphragm, etc.), and an incompressible hydraulic fluid. The compressible gas behaves much like a spring, which allows energy to be stored and dissipated, while the separator transfers these changes in energy and volume to the hydraulic fluid. Because the accumulator stores a quantity of pressurized water, the accumulator provides additional flow during high demand cycles—such as those periods where the output of the system exceeds the output capacity of the positive displacement pump. Any suitable accumulator for use in the present invention may be used.

The remainder of the pressurized water discharged from the positive displacement pump is fed to a bank of solenoid valves 4. The bank of solenoid valves may comprise as many solenoid valves as there are individual zones to control. Each solenoid valve controls the delivery of pressurized water into a respective zone. Further, each solenoid valve is in communication with a control unit such that the control unit may selectively send each solenoid valve a signal to open or close.

The pump set optionally comprises at least one fluid reservoir 5 for introducing a liquid solution into the high-pressure water fed to one or more zones. The fluid reservoir may be used to deliver an insecticide, herbicide, pesticide, or fertilizer to a particular zone. In those instances where a liquid is to be introduced into a particular zone, the discharge line emanating from the desired zone's respective solenoid valve is placed in fluid communication with a pressure-driven inductor. The pressure-driven inductor injects a controlled quantity of liquid solution into the discharge line for a particular zone. Any suitable pressure-driven inductor for use in the present invention may be used.

In one embodiment, the pump set is skid mounted 6 and enclosed in a vented metal housing 7. The entire pump set is self-contained and protected from the environment by this housing, thought panels of the housing are removable to allow easy access to the pump set for maintenance. In another embodiment, the pump set controller (and its associated power source and control logic) is mounted in a NEMA 4 housing above the vented metal housing 7.

Throughout the above discussion, the term zone has been used to denote various regions to which a supply of high-pressure water is delivered for a given purpose—such as a system for reducing the duty cycle of an air conditioner, a system for reducing the temperature around plants and/or emitting a chemical solution, a system to reduce the temperature in a living area, and a system to reduce the temperature around a swimming pool. Although the zones may be thought of as separate physical regions, it is possible that the effective areas of the zones overlap or be coextensive with one another. In this regard, it may be more appropriate to think of the zones as areas having distinct purposes for receiving the high-pressure water.

It is desirable that the pump set comprises at least as many solenoid valves as there are individual zones. However, it is foreseeable that it may be desirable to have several zones operate only simultaneously with one another. In those instances, the discharge line from a solenoid valve may split into several lines each feeding a separate zone.

The discharge lines 8, 9 emanating from the pump set are buried underground at an appropriate depth to avoid accidental rupture by foot-traffic or lawn equipment and to avoid ruptures caused by freezing. Each discharge line 8, 9 terminates in at least one atomization nozzle 10, 11. The atomization nozzles 10, 11 contain mechanisms to pulverize water by impact as well as spinning the water, effecting centrifugal atomization on discharge through the orifice into the atmosphere. The water particles generated have diameters on the order of microns (typically in the range of from about 2 to 20), which are virtually invisible to the human eye. It has been found that the use of ceramic nozzles is advantageous as it naturally deters the accumulation of salts in the nozzle orifice that would otherwise impede discharge of the water particles. Any suitable atomization nozzle for use in the present invention may be used.

FIGS. 2-9 show further details of various aspect of an exemplary embodiment of the present invention.

In view of the present disclosure or through practice of the present invention, it will be within the ability of one of ordinary skill to make modifications to the present invention, such as through the use of equivalent arrangements and compositions, in order to practice the invention without departing from the spirit of the invention as reflected in the appended claims.

What is claimed is:

1. A pumping system, comprising:

a filtration unit in fluid communication with a supply of low pressure water, wherein said filtration unit is adapted to receive a flow of low pressure water, filter impurities from said flow of low pressure water and discharge a flow of filtered water;

a pump in fluid communication with said filtration unit, said pump adapted to receive said flow of filtered water and discharge a flow of pressurized water;

a valve manifold comprising at least a first valve and a second valve in fluid communication with said pump, said at least first and second valves adapted to receive said flow of pressurized water and control said flow of pressurized water;

a first discharge line in fluid communication with said first valve and a second discharge line in fluid communication with said second valve;

a first nozzle in fluid communication with said first discharge line, said first nozzle adapted to atomize said flow of pressurized water to spray a mist in an outdoor living zone; and a second nozzle in fluid communication with said second discharge line, said second nozzle adapted to atomize said flow of pressurized water to spray a mist in a second zone.

2. The pumping system according to claim 1 wherein said filtration unit comprises at least one cartridge filter.

3. The pumping system according to claim 2 wherein at least one cartridge filter removes impurities larger than about 20 microns.

4. The pumping system according to claim 1 wherein said filtration unit removes impurities larger than about 10 microns.

5. The pumping system according to claim 1 wherein said pumping system additionally comprises at least one chemical storage tank adapted to introduce chemicals into said flow of pressurized water.

6. The pumping system according to claim 1 wherein said pumping system additionally comprises a weatherproof container which houses at least one of the following components: said filtration unit, said pump, and said valve manifold.

7. The pumping system according to claim 1 additionally comprising a control unit, said control unit in electrical communication with at least one of the following components: said filtration unit, said pump, and said valve manifold.

8. The pumping system according to claim 7 wherein said control unit is housed in NEMA 4 enclosure.

9. The pumping system according to claim 1 wherein said second zone is an outdoor living area.

10. The pumping system according to claim 1 wherein said second zone is an area around outdoor plants.

11. The pumping system according to claim 1 wherein said first outdoor living zone is an area around a swimming pool and said second zone is a second outdoor living area.

12. The pumping system according to claim 1 wherein said first and second nozzles are adapted to spray a mist into zones selected from the group consisting of: an outdoor living area, an area around outdoor plants, an area around a swimming pool, and an area around an air conditioner.

13. A pumping system comprising:

a filtration unit in fluid communication with a source of low pressure water, wherein said filtration unit is adapted to filter impurities from said low pressure water and discharge a flow of filtered water;

a pump in fluid communication with said filtration unit said pump is adapted to receive said flow of filtered water and discharge a flow of pressurized water;

a valve manifold comprising at least a first valve and a second valve in fluid communication with said pump, said at least first and second valves adapted to receive said flow of pressurized water and control said flow of pressurized water;

at least one fluid reservoir in fluid communication with said valve manifold, said at least one fluid reservoir adapted to deliver a liquid solution to at least one of said at least first and second valves;

a first discharge line in fluid communication with said first valve and a second discharge line in fluid communication with said second valve;

a first nozzle in fluid communication with said first discharge line, said first nozzle adapted to atomize said flow of pressurized water to spray a mist in a first outdoor living zone; and a second nozzle in fluid communication with said second discharge line, said second nozzle adapted to atomize said flow of pressurized water to spray a mist in a second outdoor living zone.

14. The pumping system according to claim 13 wherein said filtration unit comprises at least one cartridge filter.

15. The pumping system according to claim 14 wherein at least one cartridge filter removes impurities larger than about 20 microns.

16. The pumping system according to claim 13 wherein said filtration unit removes impurities larger than about 10 microns.

17. The pumping system according to claim 13 wherein said liquid solution is a liquid selected from the group consisting of: an insecticide, an herbicide, a pesticide and a fertilizer.

18. The pumping system according to claim 13 wherein said pumping system additionally comprises a weatherproof container which houses at least one of the following components: said filtration unit, said pump, and said valve manifold.

19. The pumping system according to claim 13 additionally comprising a control unit, said control unit in electrical communication with at least one of the following components: said filtration unit, said pump, and said valve manifold.

20. The pumping system according to claim 19 wherein said control unit is housed in NEMA 4 enclosure.

* * * * *